US005862815A

United States Patent [19]

Murphy et al.

[11] Patent Number: 5,862,815

[45] Date of Patent: Jan. 26, 1999

[54] HAIR CLIP

[75] Inventors: Martha J. Murphy; Antonio P. Piña, both of El Paso, Tex.

[73] Assignee: Helen of Troy, L.P., El Paso, Tex.

[21] Appl. No.: 926,240

[22] Filed: Sep. 8, 1997

[51] Int. Cl.[6] ..... A45D 8/20

[52] U.S. Cl. ..... 132/277; 24/556

[58] Field of Search ..... 132/277, 279, 132/273, 275, 276, 278, 132; D28/32, 39, 40, 41, 42, 43; 24/331, 511, 556, 546

[56] References Cited

U.S. PATENT DOCUMENTS

| | | | |
|---|---|---|---|
| 251,148 | 12/1881 | Wells | 24/511 |
| 884,680 | 4/1908 | Polakoskey | 24/331 |
| 5,522,407 | 6/1996 | Kelsey | 132/277 |
| 5,549,127 | 8/1996 | Chang | 132/277 |
| 5,642,740 | 7/1997 | Chen | 132/277 |
| 5,735,296 | 4/1998 | Chen | 132/277 |

*Primary Examiner*—Jeffrey A. Smith
*Assistant Examiner*—Eduardo C. Robert
*Attorney, Agent, or Firm*—John E. Toupal; Harold G. Jarcho

[57] ABSTRACT

A hair clip having a first lever member with a first jaw portion, a first actuator portion and an intermediate portion joining the first jaw portion and the first actuator portion; and a second lever member having a second jaw member, a second actuator portion and a second intermediate portion joining the second jaw portion and the second actuator portion. A hinge connects the first intermediate portion to the second intermediate portion and the first and second jaw members are shaped and arranged such that closure movement between the first and second actuator portions produces separating movement of the first and second jaw members. A spring member exerts a separating force between the first and second actuator portions and a closure force between the first and second jaw portions. Attached to and movable with at least one of the first and second actuator portions is a cover mechanism which substantially covers and conceals the spring member.

14 Claims, 4 Drawing Sheets

HAIR CLIP

BACKGROUND OF THE INVENTION

The present invention relates generally to hair clips and, more particularly, to hair clips formed by pivotable lever members.

Prior art hair clips usually have a first jaw operable by a first opening lever and a second jaw operable by a second opening lever. Intermediate connecting areas of the first and second levers are hinged together to allow the first and second jaws to pivot relative to each other about a transverse axis between an open position and a closed position. A spring urges the first and second jaws into their closed position.

In most such prior art hair clips, the spring is a metal wire coiled around the transverse pivot axis. A first end of the metal wire is extended radially away from the axis and bears against the inside surface of the first opening lever. The second end of the metal wire extends radially away from the axis and bears against the inside surface of the second opening lever. Because the spring is prestressed, its two projecting ends urge the opening levers away from each other and so urge the jaws towards their closed positions. A typical such hair clip is disclosed in U.S. Pat. No. 5,549,127. Although, functionally effective, these prior hair clips exhibit certain undesirable characteristics. For example, the employed spring members are unsightly and during use can become entangled in hair.

The object of this invention, therefore, is to provide an improved hair clip with pivotally attached lever members.

SUMMARY OF THE INVENTION

The invention is a hair clip having a first lever member with a first jaw portion, a first actuator portion and an intermediate portion joining the first jaw portion and the first actuator portion; and a second lever member having a second jaw member, a second actuator portion and a second intermediate portion joining the second jaw portion and the second actuator portion. A hinge connects the first intermediate portion to the second intermediate portion and the first and second jaw members are shaped and arranged such that closure movement between the first and second actuator portions produces separating movement of the first and second jaw members. A spring member exerts a separating force between the first and second actuator portions and a closure force between the first and second jaw portions. Attached to and movable with at least one of the first and second actuator portions is a cover mechanism which substantially covers and conceals the spring member. The cover mechanism alleviates problems associated with conventional hair clips.

According to one feature of the invention, the spring member is a coiled spring having one end engaging the first actuator portion and an opposite end engaging the second actuator portion so as to bias the first and second jaw members into closed positions and the first and second actuator portions into open positions defining therebetween a gap retaining the spring member. The cover mechanism covers at least that portion of the gap retaining the spring member.

According to one embodiment of the invention, the cover mechanism includes a first cover portion joined to the first actuator portion by a first pivot joint, and a second cover portion joined to the second actuator portion by a second pivot joint and to the first cover portion by a third pivot joint.

The first and second cover portions are shaped and arranged such that closure movement between the first and second actuator portions produces pivotal movement of the first cover portion at the first and third pivot joints, and pivotal movement of the second cover portion at the second and third pivot joints. Necessary movement of the cover portions during opening actuation of the hair clip is accommodated by the first, second and third pivot joints.

According to one feature of the above embodiment, the first and second cover portions are formed by a single molded piece, the third pivot joint is a living hinge; and the pivotal movement moves the third pivot joint away from the spring member.

According to another embodiment of the invention, the cover mechanism includes at least one cover member having one edge portion attached to the first actuator portion and an opposite edge portion disposed adjacent to the second actuator portion and with the one cover member being shaped and arranged to move over the second actuator portion in response to closure movement between the first and second actuator portions. Necessary movement of the cover member is accommodated by this arrangement.

According to one feature of the above embodiment, the second intermediate portion defines an opening for receiving the opposite edge portion in response to a given degree of closure movement between the first and second actuator portions. The opening allows extensive relative movement of the cover member.

According to other features of the above embodiment, the one cover member has a concave surface facing the spring member and a convex surface facing away therefrom. The concave geometry also facilitates desired movement of the cover member.

According to other features of the above embodiment, the cover mechanism further includes a second cover member having a first edge portion attached to the second actuator portion and a second edge portion disposed adjacent to the first actuator portion, a third cover member having a first edge portion attached to the second actuator portion and a second edge portion disposed adjacent to the first actuator portion, and wherein the first and second cover portions straddle the one cover member and are shaped and arranged to move over the first actuator portion in response to closure movement between the first and second actuator portions. This arrangement facilitates opening actuation of the hair clip.

According to other features of the embodiment, the second intermediate portion defines a first opening for receiving the opposite edge portion in response to a given degree of closure movement between the first and second actuator portions, and the first intermediate portion defines second and third openings for receiving, respectively, the second edge portions of the second and third cover members in response to the given degree of closure movement. The openings allow extensive relative movement of the cover members.

According to still other features of the embodiment, the one, second and third cover members have concave surfaces facing the spring member and convex surfaces facing away therefrom. The concave geometry accommodates desired movement of the cover members.

According to yet other features of the embodiment, a decorative overlay member is attached to each of said convex surfaces and has a curvature conforming thereto. The overlay members enhance the appearance of the hair clip.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
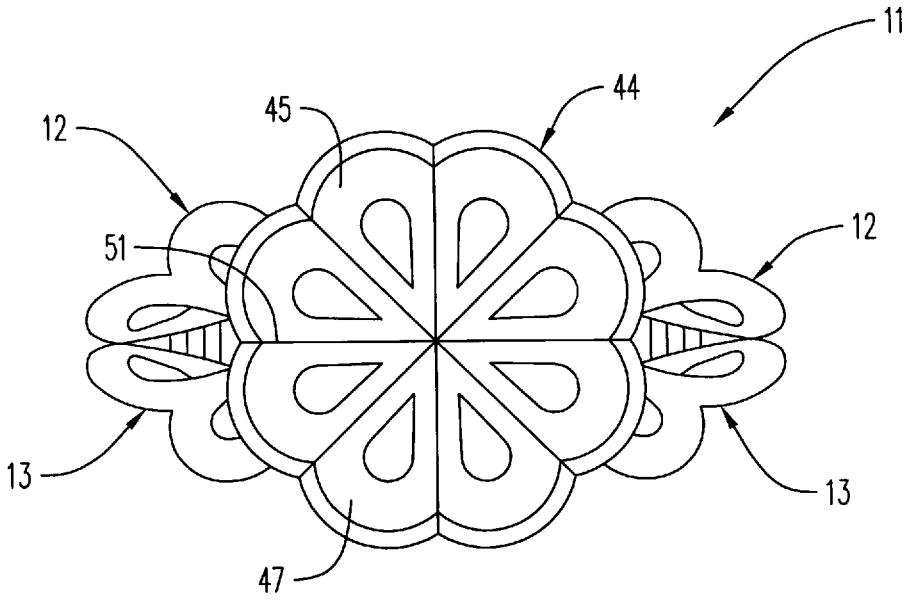
FIG. 1 is a top view of a hair clip embodiment of the invention.
Figure 2:
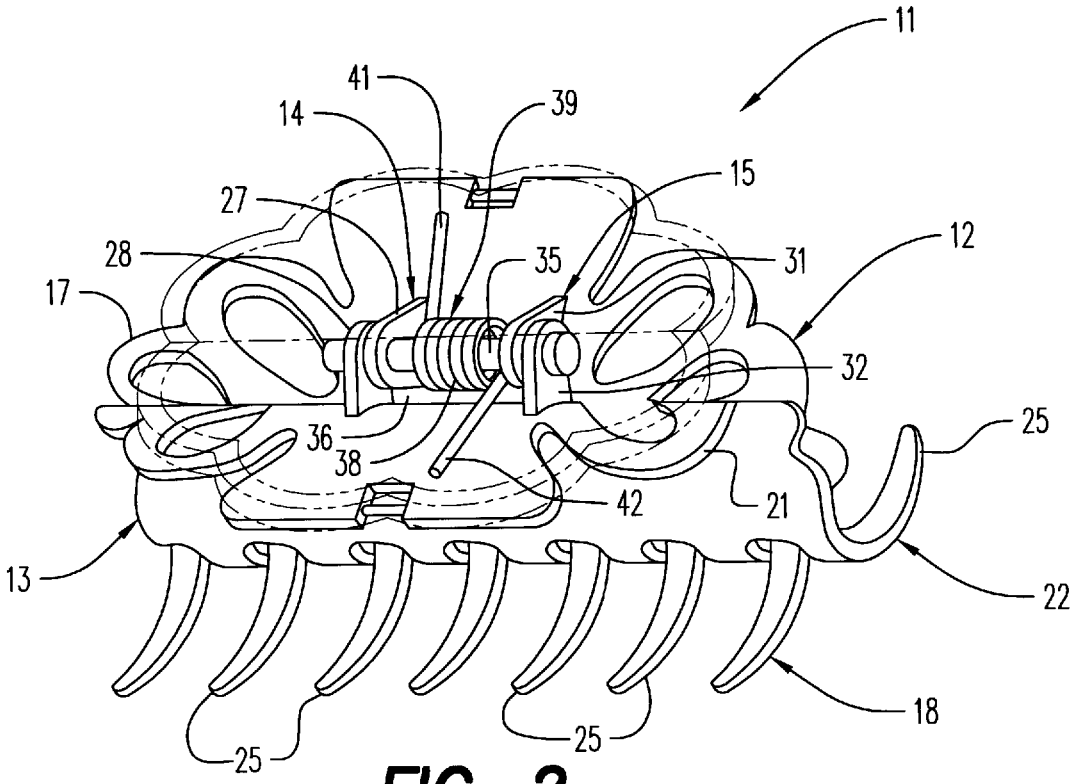
FIG. 2 is a perspective view of the hair clip shown in FIG. 1 with a cover member shown in phantom.

A hair clip 11 includes a first lever member 12 connected to a second lever member 13 by a pair of hinges 14, 15 as shown in FIGS. 1 and 2. The first lever member 12 includes a first actuator portion 17 joined to a first jaw portion 18 by a first intermediate portion 19. Similarly, the second lever member 13 includes a second actuator portion 21 joined to a second jaw portion 22 by a second intermediate portion 23. Each of the first and second jaw portions 18, 22 defines a plurality of spaced apart teeth 25.

As shown in FIG. 2, the first hinge 14 includes a first lug 27 projecting from the first intermediate portion 19 and a second lug 28 projecting from the second intermediate portion 23 and adjacent to the first lug 27. Similarly, the second hinge 15 includes a third lug 31 projecting from the first intermediate portion 19 and a fourth lug 32 projecting from the second intermediate portion 23 and adjacent to the third lug 31. A hinge pin 35 extends through an aperture in each of the first, second, third, and fourth lugs 27, 28, 31 and 32. Received by the pin 35 and positioned within a space 36 separating the first hinge 14 from the second hinge 15 is a cylindrical body portion 38 of a coiled spring member 39. One end 41 of the spring member 39 engages the first actuator portion 17 and opposite end 42 of the spring member 39 engages the second actuator portion 21.

Figure 3:
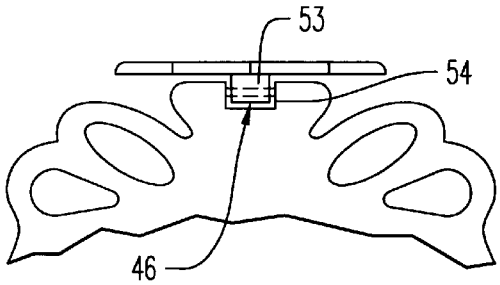
FIG. 3 is a partial front view of the hair clip shown in FIG. 1.
Figure 4:
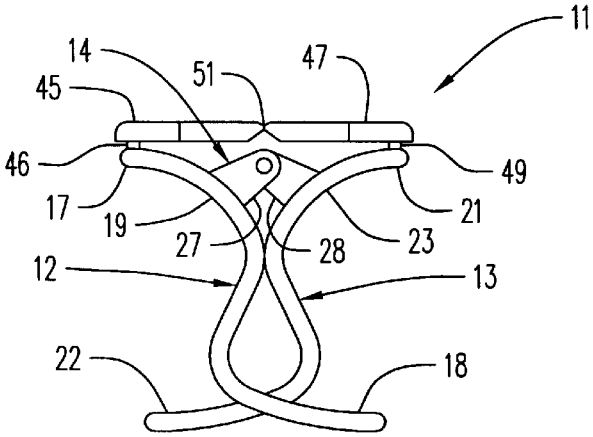
FIG. 4 is a left elevational view of the hair clip which is identical to a right elevational view thereof.

A circular cover 44 with a scalloped periphery (FIG. 1) has a first one-half cover portion 45 joined to the first actuator portion 17 by a first pivot link 46 and a second one-half cover portion 47 joined to the second actuator portion 21 by a second pivot joint 49. Connecting the first and second cover portions 45, 47 is a third diametrically extending pivot joint 51. Preferably, the cover 44 is a molded single plastic piece and the pivot joint 51 constitutes a living hinge formed by a diametrically extending reduced land area between the first and second cover portions 45, 47 as shown in FIG. 4. The cover 44 extends over the first and second hinges 14, 15 and the space 36 therebetween so as to substantially conceal the spring member 39. Forming the first pivot joint 46 (FIG. 3) is a lug 53 first cover portion 45 and press fitted into and pivotal within a notch 54 formed in an outer edge of the first actuator portion 17. The second pivot joint 49 is formed identically to the first pivot joint 46.

Figure 5:
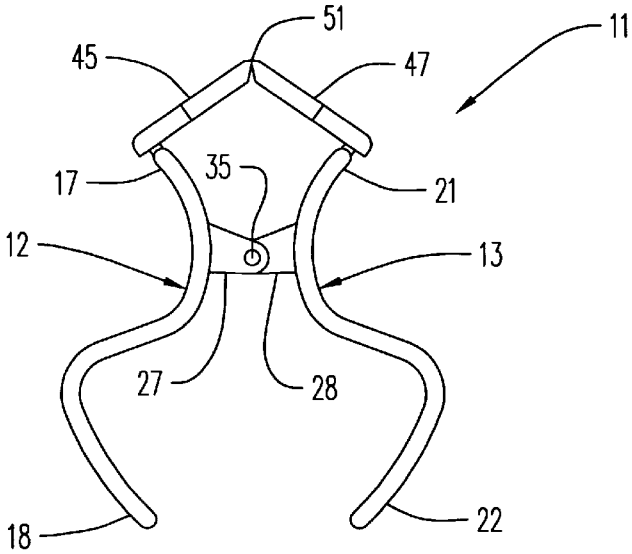
FIG. 5 is a left elevational view with components of the clip in different operating positions than those shown in FIG. 4.
Figure 6:
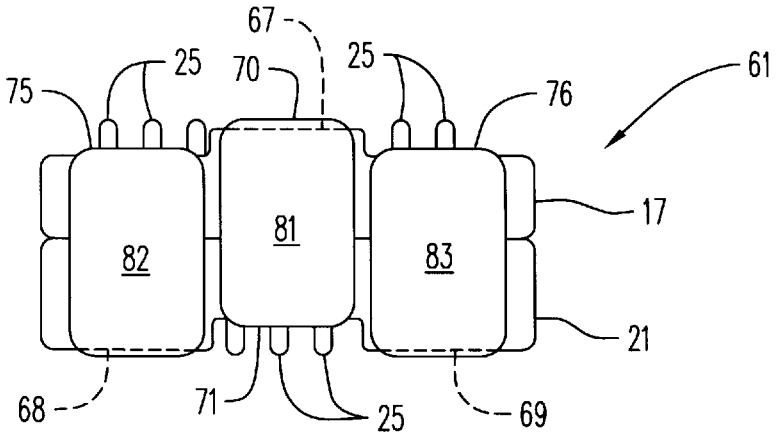
FIG. 6 is a top view of another hair clip embodiment of the invention.

The spring member 39 exerts a separating force between the first and second actuator portions 17, 21 and a closure force between the first and second jaw portions 18, 22 so as to bias the first and second lever members 12, 13 into the positions shown in FIG. 4. In response to manually applied force on the first and second actuator portions 17, 22, however, the first and second lever members 12, 13 are pivoted into the positions shown in FIG. 5 with the first and second jaw portions 18, 22 separated so as to facilitate access of hair (not shown) therebetween. During movement of the lever members 12, 13 between the positions shown in FIGS. 4 and 5, pivotal motion occurs at the first and second pivot joints 46, 49 between, respectively, the first and second cover portions 45, 47 and the first and second actuator portions 17, 21. Also, pivotal motion occurs at the third pivot joint 51 between the first and second cover portions 45, 47 allowing movement thereof away from the spring member 39 as illustrated in FIG. 5. Release of manual pressure on the first and second actuator portions 17, 21 allows the spring member 39 to return the first and second lever members 12, 13 into the positions shown in FIG. 4 with the first and second jaw portions 18, 22 closed on grasped hair (not shown).

Another hair clip embodiment 61 is depicted in FIGS. 6–10. With the exception of the cover 44, the hair clip 61 is substantially identical to the hair clip 11 and identical components thereof bear the same reference numerals. In the hair clip embodiment 61, the cover 44 of the embodiment 11 is replaced by one cover member 63 and straddling second and third cover members 64, 65. One edge portion 67 of the one cover member 63 is attached to an outer edge of the first actuator portion 17 and first edges 68, 69 of, respectively, the second and third cover members 64, 65 are attached to outer edge portions of the second actuator portion 21. With the first and second lever members 12, 13 in the closed position shown in FIG. 9, an opposite edge 71 of the one cover member 63 is positioned adjacent to the outer edge of the second actuator portion 21. Similarly, second edges 75, 76 of, respectively, the second and third cover members 64, 65 are positioned adjacent to the outer edge of the first actuator portion 17. Each of the cover members 63–65 has a concave inner surface facing the hinges 14, 15 and spring member 39 and an outer convex surface facing away therefrom. As with the embodiment 11, the cover members 63–65 of embodiment 61 cover and substantially conceal the hinges 14, 15 and spring member 39. Attached to and coextensive with the outer convex surfaces of the cover members 63–65 are, respectively, decorative overlay members 81–83.

Figure 7:
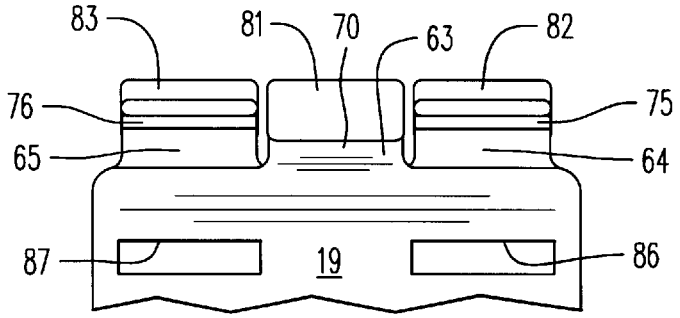
FIG. 7 is a partial rear view of the hair clip shown in FIG. 6.
Figure 8:
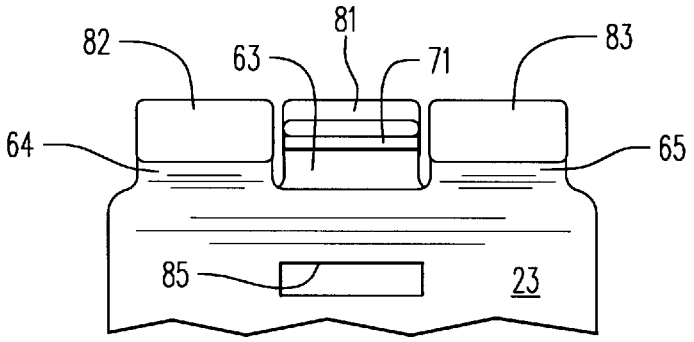
FIG. 8 is a partial front view of the hair clip shown in FIG. 6.
Figure 9:
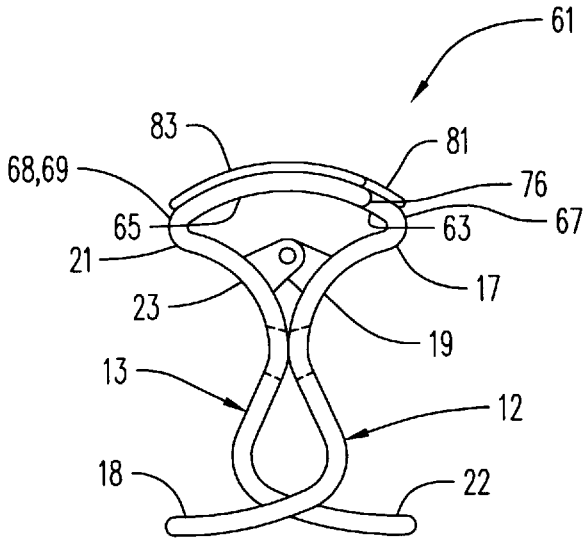
FIG. 9 is a right elevational view of the hair clip shown in FIG. 6.
Figure 10:
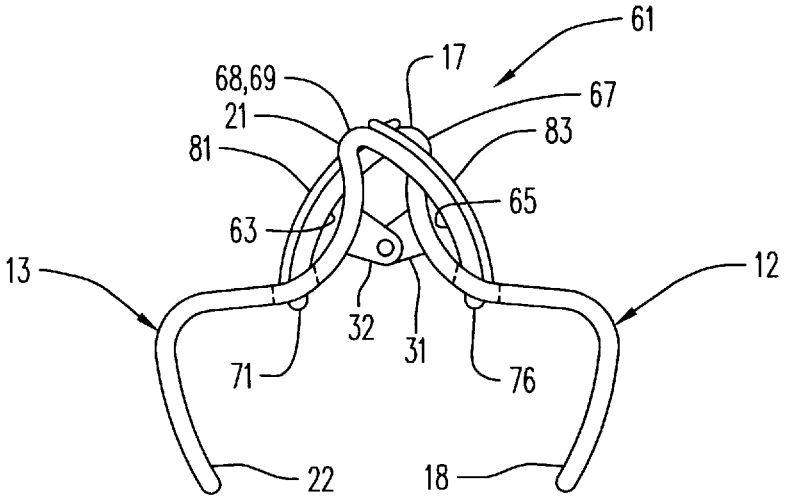
FIG. 10 is a right elevational view showing components of the clip in different operating positions than those shown in FIG. 9.

The exertion of manual pressure on the first and second actuator portions 17, 21 moves the first and second lever members 12, 13 into the positions shown in FIG. 10 with the first and second jaw portions 18, 22 separated. During the opening movement of the lever members 12, 13, the one cover member 63 moves over the outer edge of the second actuator portion 21 and the second and third cover members 64, 65 move over the outer edge portions of the first actuator portion 17. After a given degree of such movement, the opposite edge 71 of the one cover member 63 enters a first opening 85 (FIG. 8) in the second intermediate portion 23 and the second edges 75, 76 of, respectively, the second and third members 64, 65 enter, respectively, second and third openings 86, 87 in the first intermediate portion 19 (FIG. 7). Release of manual pressure on the first and second actuator portions 17, 21 allows the spring member to return the first and second lever members 12, 13 into the positions shown in FIG. 9 with the first and second jaw members 18, 22 closed on grasped hair (not shown).

Obviously, many modifications and variations of the present invention are possible in light of the above teachings. It is to be understood, therefore, that the invention can be practiced otherwise than as specifically described.

What is claimed is:

1. A hair clip comprising:

a first lever member having a first jaw portion, a first actuator portion and an intermediate portion joining said first jaw portion and said first actuator portion;

a second lever member having a second jaw member, a second actuator portion and a second intermediate portion joining said second jaw portion and said second actuator portion;

hinge means connecting said first intermediate portion to said second intermediate portion; said first and second jaw members being shaped and arranged such that closure movement between said first and second actuator portions produces separating movement of said first and second jaw members;

a spring member exerting a separating force between said first actuator portion and said second actuator portion, and exerting a closure force between said first jaw portion and said second jaw portion; and a cover means attached to and movable with at least one of said first and second actuator portions; said cover means substantially concealing said spring member and comprising at least one cover member having one edge portion attached to said first actuator portion and an opposite edge portion disposed adjacent to said second actuator portion, said one cover member being shaped and arranged to move over said second actuator portion in response to closure movement between said first and second actuator portions; and wherein said second intermediate portion defines an opening for receiving said opposite edge portion in response to a given degree of said closure movement between said first and second actuator portions.

2. A hair clip according to claim 1 wherein said spring member biases said first and second jaw members into closed positions and biases said first and second actuator portions into open positions defining therebetween a gap retaining said spring member, and wherein said cover means covers at least that portion of said gap retaining said spring member.

3. A hair clip according to claim 2 wherein said spring member is a coiled spring having one end engaging said first actuator portion and an opposite end engaging said second actuator portion.

4. A hair clip according to claim 3 wherein said hinge means comprises a first lug projecting from said first intermediate portion; a second lug projecting from said second intermediate portion and adjacent to said first lug; a third lug projecting from said first intermediate portion; a fourth lug projecting from said second intermediate portion and adjacent to said third lug, and first and second lugs being separated from said third and fourth lugs by a space; and a pin extending through apertures in each of said first, second, third and fourth lugs; and wherein said coiled spring has a cylindrical body portion receiving said pin and disposed in said space.

5. A hair clip according to claim 1 wherein said one cover member has a concave surface facing said spring member and a convex surface facing away therefrom

6. A hair clip according to claim 5 including a decorative overlay member attached to said convex surface and having a curvature conforming thereto.

7. A hair clip comprising:

a first lever member having a first jaw portion, a first actuator portion and an intermediate portion joining said first jaw portion and said first actuator portion;

a second lever member having a second jaw member, a second actuator portion and a second intermediate portion joining said second jaw portion and said second actuator portion;

hinge means connecting said first intermediate portion to said second intermediate portion; said first and second jaw members being shaped and arranged such that closure movement between said first and second actuator portions produces separating movement of said first and second jaw members;

a spring member exerting a separating force between said first actuator portion and said second actuator portion, and exerting a closure force between said first jaw portion and said second jaw portion; and a cover means attached to and movable with at least one of said first and second actuator portions; said cover means substantially concealing said spring member and comprising one cover member having one edge portion attached to said first actuator portion and an opposite edge portion disposed adjacent to said second actuator portion, a second cover member having a first edge portion attached to said second actuator portion and a second edge portion disposed adjacent to said first actuator portion, and a third cover member having a first edge portion attached to said second actuator portion and a second edge portion disposed adjacent to said first actuator portion; and wherein said one cover member is shaped and arranged to move over said second actuator portion in response to closure movement between said first and second actuator portions, and first and second edge portions are shaped and arranged to move over said first actuator portion in response to said closure movement between said first and second actuator portions.

8. A hair clip according to claim 7 wherein said second intermediate portion defines a first opening for receiving said opposite edge portion in response to a given extent of said closure movement between said first and second actuator portions, and said first intermediate portion defines second and third openings for receiving, respectively, said second edge portions of said second and third cover members in response to said given extent of said closure movement.

9. A hair clip according to claim 7 wherein said spring member biases said first and second jaw members into closed positions and biases said first and second actuator portions into open positions defining therebetween a gap retaining said spring member, and wherein said cover means covers at least that portion of said gap retaining said spring member.

10. A hair clip according to claim 9 wherein said spring member is a coiled spring having one end engaging said first actuator portion and an opposite end engaging said second actuator portion.

11. A hair clip according to claim 10 wherein said hinge means comprises a first lug projecting from said first intermediate portion; a second lug projecting from said second intermediate portion and adjacent to said first lug; a third lug projecting from said first intermediate portion; a fourth lug projecting from said second intermediate portion and adjacent to said third lug, and first and second lugs being separated from said third and fourth lugs by a space; and a pin extending through apertures in each of said first, second, third and fourth lugs; and wherein said coiled spring has a cylindrical body portion receiving said pin and disposed in said space.

12. A hair clip according to claim 7 wherein said second and third cover members straddle said one cover member.

13. A hair clip according to claim 12 wherein each of said one, second and third cover members have concave surfaces facing said spring member and convex surfaces facing away therefrom.

14. A hair clip according to claim 13 including a decorative overlay member attached to each of said convex surfaces and having a curvature conforming thereto.

* * * * *